US005256027A

United States Patent [19]

Guest

[11] Patent Number: 5,256,027

[45] Date of Patent: Oct. 26, 1993

[54] LIFTING APPARATUS

[75] Inventor: Stephen J. Guest, Leeton, Australia

[73] Assignee: Stevelift Pty Ltd A.C.N., South Wales, Australia

[21] Appl. No.: 847,073

[22] Filed: Jun. 8, 1992

[30] Foreign Application Priority Data

Oct. 12, 1989 [AU] Australia ..... PJ6835

[51] Int. Cl.[5] ..... B66C 23/00

[52] U.S. Cl. ..... 414/737; 414/408; 414/421; 414/918

[58] Field of Search ..... 414/737, 917, 408, 421

[56] References Cited

U.S. PATENT DOCUMENTS

| | | | |
|---|---|---|---|
| 2,949,199 | 8/1990 | Jones . | |
| 4,091,944 | 5/1978 | Gollnick | 298/23 MD |
| 4,726,726 | 2/1988 | Dossena et al. | 414/408 |
| 4,978,269 | 12/1990 | Niederer | 414/408 X |
| 5,024,573 | 6/1991 | Redding et al. | 414/408 |
| 5,033,930 | 7/1991 | Kraus . | |

FOREIGN PATENT DOCUMENTS

| | | |
|---|---|---|
| 82407/82 | 4/1982 | Australia . |
| 2106388 | 2/1989 | Australia . |
| 287433 | 10/1988 | European Pat. Off. . |
| 327948 | 8/1989 | European Pat. Off. . |
| 2558466 | 12/1975 | Fed. Rep. of Germany . |
| 2920900 | 12/1980 | Fed. Rep. of Germany . |
| 3106333 | 12/1982 | Fed. Rep. of Germany . |

OTHER PUBLICATIONS

International Search Report for International Application Serial No. PCT/AU90/00488.

*Primary Examiner*—Michael S. Huppert
*Assistant Examiner*—Donald W. Underwood
*Attorney, Agent, or Firm*—Willian Brinks Olds Hofer Gilson & Lione

[57] ABSTRACT

A lifting apparatus to be attached to a side of a garbage collection truck. The apparatus comprises a series of linkages mounted to a mounting member attached to the vehicle. A plurality of suction cups is provided on a garbage bin securing member. A vacuum supply to the suction cups is actuated by means of a trip switch mounted adjacent to the suction cups. The trip switch is activated as it abuts the side of a garbage bin. The vacuum supply is disconnected as the bin securing member returns past a predetermined position. In a preferred embodiment, the securing member is mounted on lateral shift rails to allow for positional adjustment of the bin securing member relative to the bin. The apparatus is adapted to raise a garbage bin from a position generally adjacent the truck to a raised and inverted position adjacent to an entry chute of a garbage compactor of the garbage truck.

5 Claims, 5 Drawing Sheets

LIFTING APPARATUS

The present invention relates to a garbage bin lifting means for garbage collection vehicles.

Present garbage trucks use hydraulically operated securing means to lift garbage bins. Such securing means comprise mechanical arms attached to main lifting arms which are adapted to grab mobile garbage bins such as "rapid-rails", "otto" bins etc. The arms move to a predetermined position with respect to the bin and, when the main lifting arm is raised, they engage a circumferential ridge portion of the bin.

The bin is lifted by the main lifting arms until it is held up-side down over the entry chute of the garbage bin truck compactor. The bin is prevented from slipping off the arms of the lifting means by a retaining portion on the securing means.

These known types of garbage bin lifting apparatus are not adapted for picking up both common available 120 liter and 240 liter sized bins. That is, known lifting apparatus is usually only adapted to lift one size of bin.

Further, the cycle time for this type of lifting apparatus is relatively long since the action of the arms can be quite slow.

It is the object of the present invention to overcome or substantially ameliorate the problems and/or disadvantages of the prior art.

In one broad from the present invention provides apparatus comprising:

lifting means to be attached to a vehicle, object securing means mounted to said lifting means so as to be lifted thereby, said lifting means being moveable between a retracted position wherein said object securing means is located adjacent an object to be lifted and an extended position wherein said object securing means is in a raised, essentially inverted position, and wherein said object securing means comprises suction fastening means connected to a vacuum supply and switch means adapted to be activated or deactivated at a predetermined position during movement of said lifting means so as to supply or disconnect said vacuum.

Figure 1:
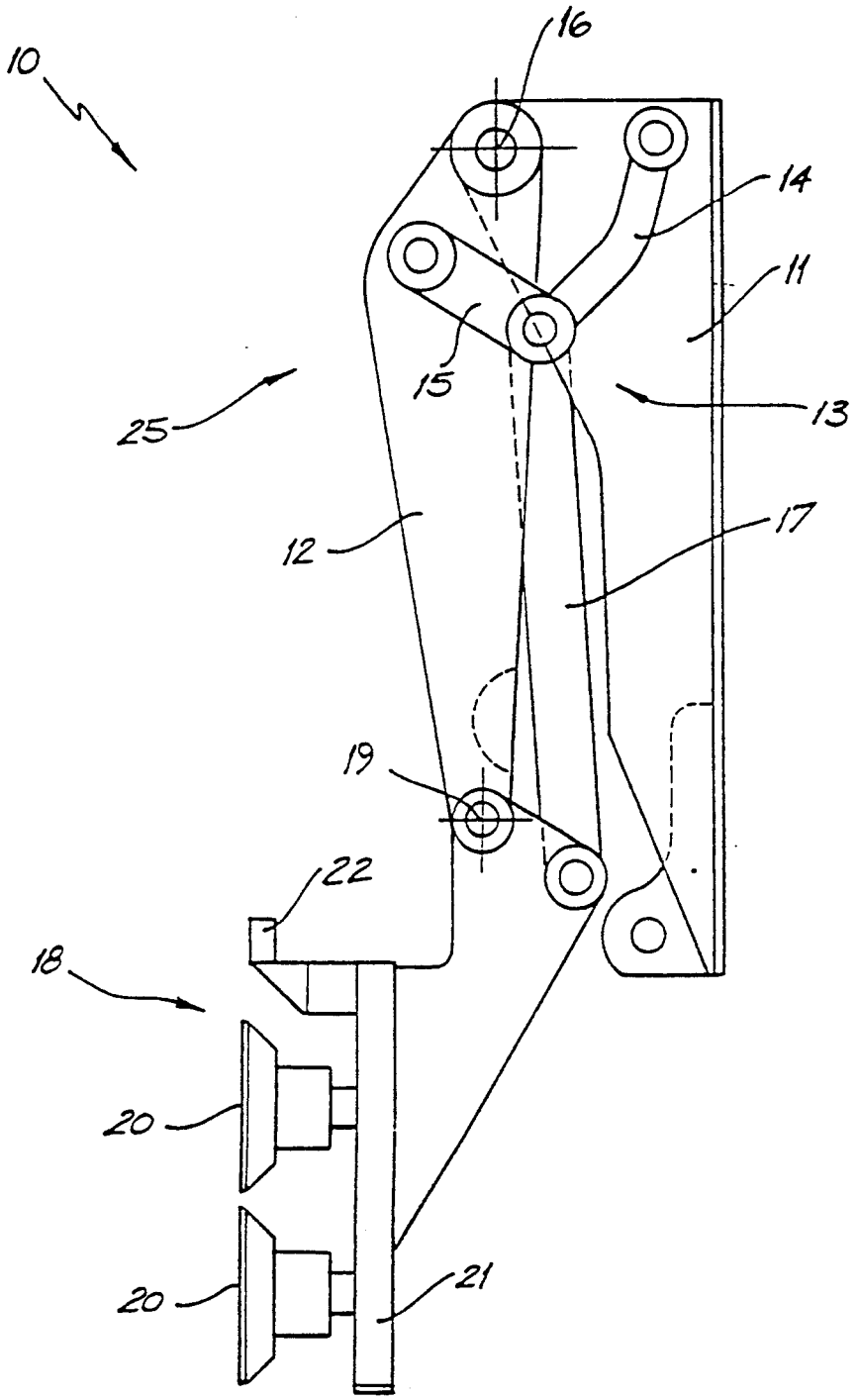
Figure 2:
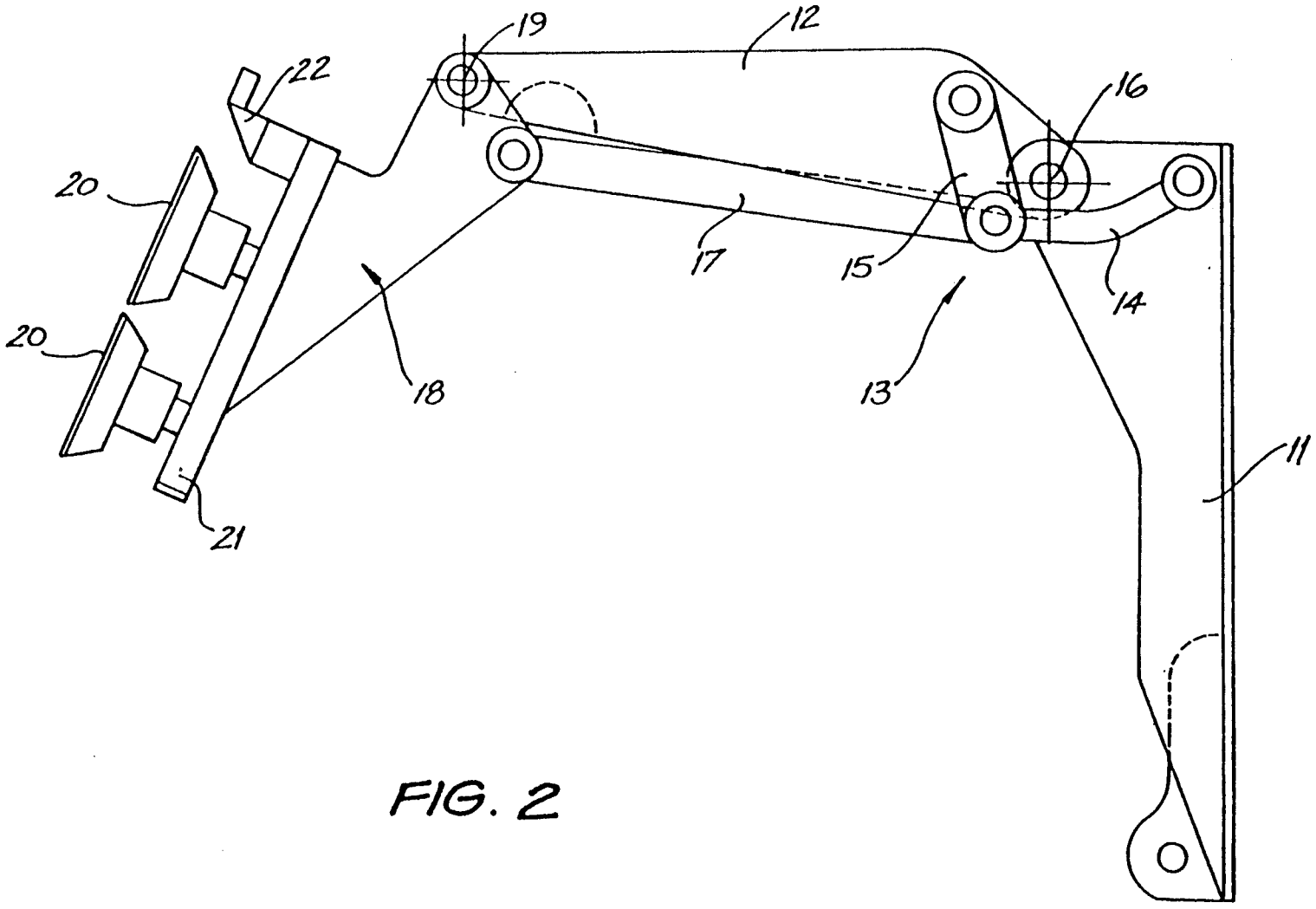
Figure 3:
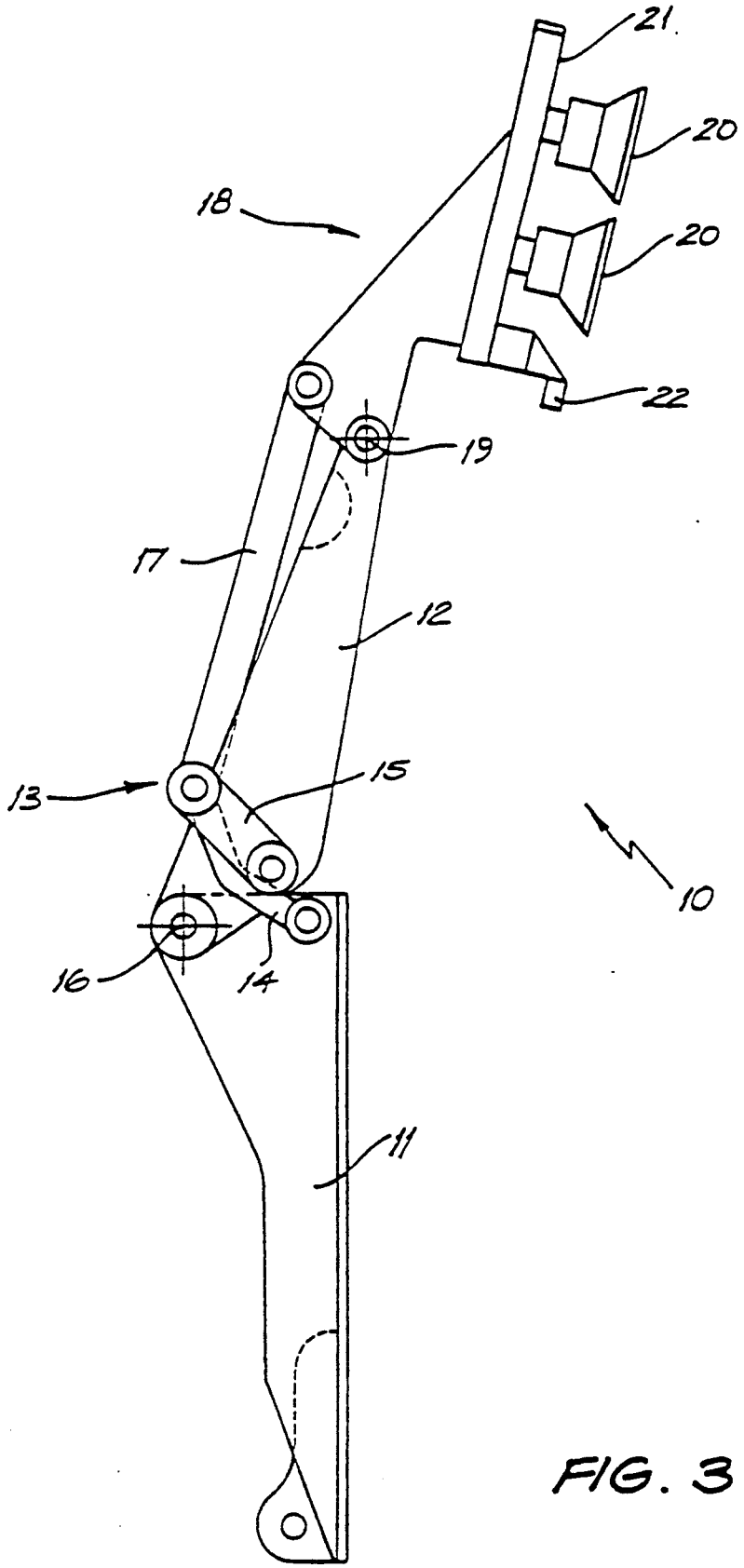
Figure 4:
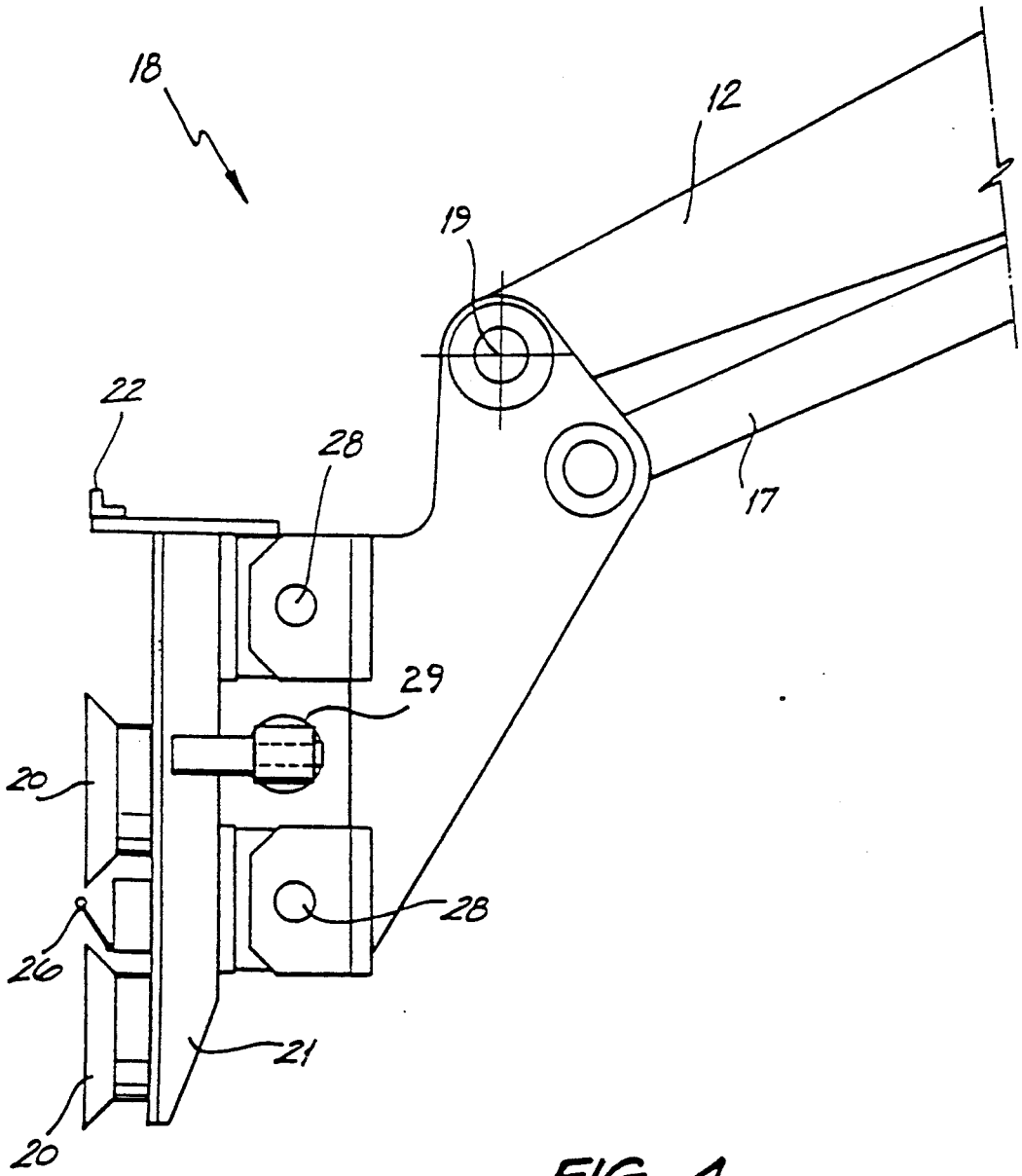
Figure 5:
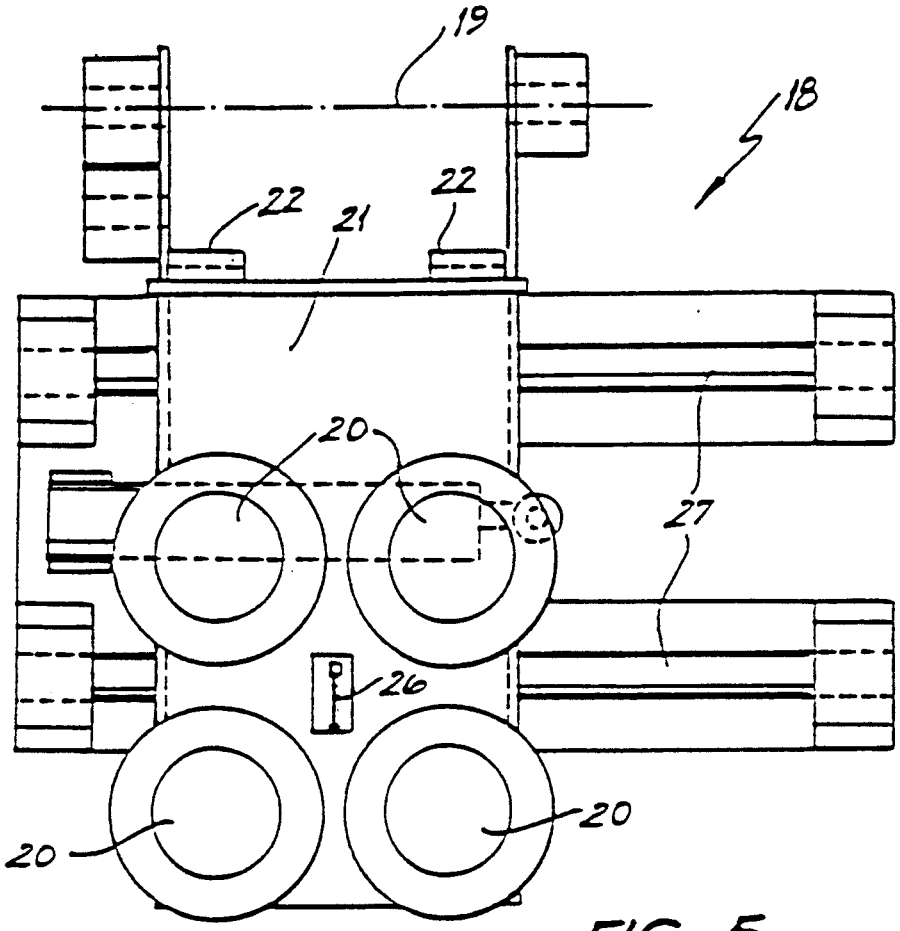
Figure 6:
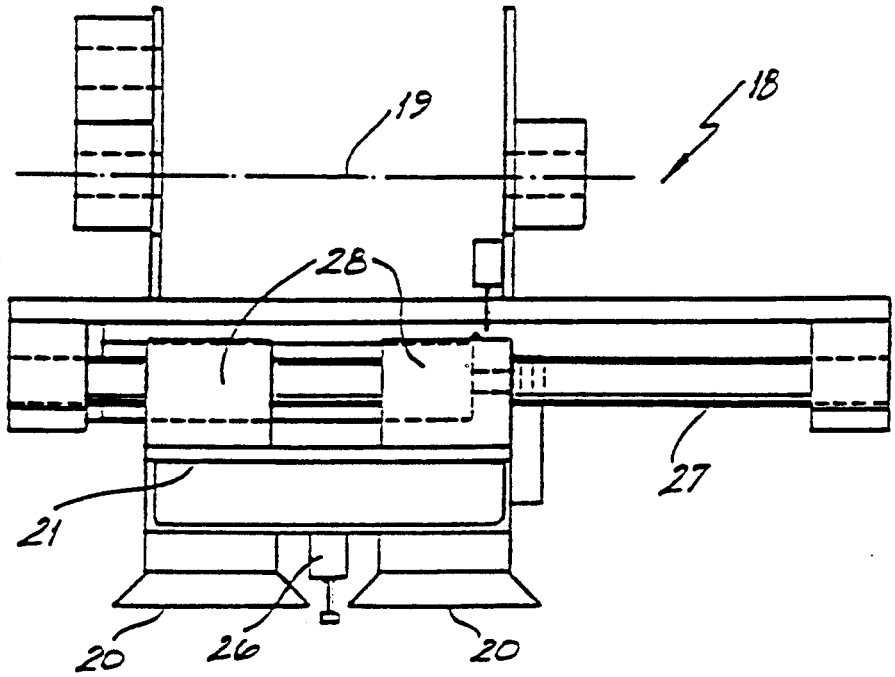

A preferred form of the present invention will now be described by way of example with reference to the accompanying drawings, wherein:

FIG. 1 is a side elevational view of the lifting apparatus of the present invention in a folded configuration, FIG. 2 is a side elevational view of the apparatus of FIG. 1 in a mid-way position of the lifting means, FIG. 3 is a side elevational view of the apparatus of FIG. 1 in a fully raised position, FIG. 4 is a side elevational view of an alternative embodiment of the lifting apparatus of the present invention, FIG. 5 is a front elevational view of the apparatus of FIG. 4, and FIG. 6 is a plan view of the apparatus of FIGS. 4 and 5.

In the accompanying drawings, there is schematically depicted a lifting apparatus 10 to be mounted to a garbage truck (not shown) having a garbage compactor. Preferably, the lifting apparatus 10 is used in conjunction with a garbage truck adapted for control by a single operator.

The lifting apparatus 10 comprises a lifting mechanism 25 which comprises a mounting member 11 to be attached to a side of the truck in a generally vertical position adjacent to the entry chute of the compactor.

Pivotally mounted to the mounting member 11 proximate its top end is the lifting arm 12 which is movable relative to the member 11 between a retracted position (see FIG. 1) generally coextensive and parallel to the mounting member 11, and a fully extended position (see FIG. 3). FIG. 2 shows the lifting arm 12 in a mid-way position.

Pivotally mounted to the other end of the lifting arm 12 is a bin securing apparatus 18 which is adapted to releasably retain a bin when the lifting arm 12 is being raised and lowered.

A linkage arrangement 13 is also provided so that the bin which is being lifted by the lifting apparatus 10 is kept generally upright until it is over the entry chute of the compactor. This is necessary to prevent the garbage within the bin from being discharged before arriving at an appropriate position relative to the truck.

The linkage arrangement 13 comprises a first member 14 pivotally mounted to the mounting member 11 at a position spaced from the pivotal axis 16 of the lifting arm 12 to the mounting member 11; a second member 15 pivotally mounted to the lifting arm 12 at a position spaced from the axis 16, and a third member 17 pivotally mounted to the bin securing apparatus 18 at a position spaced from the pivotal axis 19 between the apparatus 18 and the lifting arm 12.

The second and third members 15, 17, the lifting arm 12 and the bin securing apparatus 18 are connected in such a way so as to generally define a parallelogram linkage which maintains a particular orientation of the securing apparatus 18 relative to the ground within a certain range of movement of the lifting arm 12. After this range of movement of the lifting arm 12 is exceeded, the first member 14 causes the apparatus 18 to pivot with respect to the lifting arm 12 as it completes its rotation about the mounting member 11 into the fully raised position (see FIG. 3).

In addition to bin lip support blocks 22 which are adapted to catch under a peripheral lip of a bin to be lifted, the bin securing apparatus 18 comprises two or four for example suction cups 20 which are mounted to a straight face 21 of the apparatus 18. When the lifting arm 12 is in the folded position, the suction cups 20 face outwards from the truck and are aligned generally vertically.

Communicating with each of the suction cups 20 is an air hose (not shown) which are each connected to a vacuum supply via an air operated trip switch 26.

In accordance with a further embodiment of the present invention, the bin securing apparatus 18 comprises a number of shift rails 27. In this particular embodiment, the straight face 21 is mounted to the shift rails 27 by means of linear bearings 28. Such a configuration allows for lateral transfer of the suction cups 20 to compensate for any inaccuracy of the garbage truck in its parked relationship to the bin to be lifted. Shift cylinder 29 is provided as a means by which a shifting force is applied to the bin securing apparatus 18 so as to be transferred along shift rails 27.

In use, the lifting arm 12 is moved away from the folded position which activates the air operated trip switch 26 so as to provide a vacuum to each of the suction cups 20. In the embodiment depicted, the trip switch 26 activates as it engages with the side of the bin to be lifted.

The suction cups 20 are initially adjacent the bin. A projection 22 also projects from the face 21 of the apparatus 18, which is positioned to butt up against the side face of the bin while it is adhered to the apparatus 18.

The suction caps 20 engage a side face of the bin and adhere thereto allowing the bin to be lifted by further pivoting motion of the lifting arm 12 towards the extended position. When the lifting arm 12 is in the fully extended position, the garbage within the bin is emptied into the garbage compactor.

After the bin has been emptied, the lifting arm 12 is moved back towards the folded position. When the lifting arm 12 reaches the folded position, the air operated trip switch 26 closes off the vacuum to the suction caps 20 thus allowing the bin to be released and placed back onto the ground.

Typically, the cycle time of the present invention is approximately 3 to 6 seconds from the initial folded position to the bin-empty and back to rest (folded position).

The claims defining the invention are as follows:

1. Apparatus comprising:

lifting means to be attached to a vehicle, object securing means mounted to said lifting means so as to be pivotally lifted thereby, said lifting means being moveable between a retracted position wherein said object securing means is located adjacent an object to be lifted and an extended position wherein said object securing means is in a raised, essentially inverted position, wherein said object securing means comprises suction fastening means connected to a vacuum supply and switch means located in a position adjacent said suction means so as to be activated or deactivated upon interaction with said object at a predetermined position during movement of said lifting means so as to supply or disconnect said vacuum, and wherein said lifting means comprises a mounting member to be attached to said side of a vehicle in a generally vertical orientation, and wherein said lifting means comprises a lifting arm pivotally mounted proximate a top end of said mounting member, the lifting arm being moveable relative to the mounting member between said retracted and extended positions such that in said retracted position, said lifting arm is generally coextensive and parallel with the mounting member, and further comprising a first member pivotally mounted at one end to said mounting member at a position spaced from a pivot axis of the lifting arm, a second member pivotally mounted at one end to the lifting arm at a position spaced from the said axis, and a third member pivotally mounted at one end to the object securing means at a position spaced from a pivot axis between the object securing means and the lifting arm, the other ends of the first, second and third members being mutually pivotally interconnected such that said second member, said third member, said lifting arm and said object securing means define a parallelogram linkage which maintains a particular orientation of the object securing means relative to the ground within a predetermined range of movement of the lifting arm.

2. Apparatus according to claim 1 wherein said suction fastening means comprises a plurality of suction cups.

3. Apparatus of claim 2 wherein in said retracted position, the suction cups face outwards from said vehicle and are aligned essentially vertically,

4. Apparatus of claim 1 wherein said switch means comprises a trip switch to be activated by contact with said object to be lifted.

5. Apparatus as claimed in claim 2 wherein said object securing means further comprises at least one shift rail onto which the suction cups are mounted by way of a face member which is mounted to slide laterally along said at least one shift rail.

* * * * *

UNITED STATES PATENT AND TRADEMARK OFFICE

CERTIFICATE OF CORRECTION

PATENT NO. : 5,256,027

DATED : October 26, 1993

INVENTOR(S) : Stephen J. Guest

It is certified that error appears in the above-identified patent and that said Letters Patent is hereby corrected as shown below:

Column 1, line 29, please delete "from" and substitute --form--.

Column 3, line 7, please delete "caps" and substitute --cups--.

Column 3, line 17, please delete "caps" and substitute --cups--.

COLUMN 4:

Claim 3, line 3, after "vertically" please delete "," and substitute --.--.

Signed and Sealed this

Thirteenth Day of September, 1994

*Attest:*

*Attesting Officer*

Bruce Lehman

BRUCE LEHMAN

*Commissioner of Patents and Trademarks*